US005956770A

United States Patent [19]

Dennis

[11] Patent Number: 5,956,770

[45] Date of Patent: Sep. 28, 1999

[54] GLOVE WITH ATTACHABLE CLEANING PADS

[76] Inventor: Lewis Felts Dennis, 4099 Bismark Dr., San Jose, Calif. 95130

[21] Appl. No.: 09/193,818

[22] Filed: Nov. 17, 1998

[51] Int. Cl.[6] ..... A41D 19/00

[52] U.S. Cl. ..... 2/160; 15/227

[58] Field of Search ..... 2/158, 159, 160, 2/161.1, 161.3, 163; 15/227

[56] References Cited

U.S. PATENT DOCUMENTS

| | | | |
|---|---|---|---|
| D. 268,967 | 5/1983 | Sami | D2/373 |
| D. 268,968 | 5/1983 | Sami | D2/373 |
| 2,651,071 | 9/1953 | Dyer et al. | 2/159 |
| 3,885,249 | 5/1975 | De Brabander | 2/161 |
| 4,593,427 | 6/1986 | Ortolivo | 15/227 |
| 4,621,388 | 11/1986 | Ortolivo | 15/227 |
| 5,419,014 | 5/1995 | Piantedosi | 15/227 |
| 5,442,816 | 8/1995 | Seketa | 2/161 |
| 5,682,837 | 11/1997 | Courtney et al. | 119/625 |

*Primary Examiner*—Diana L. Oleksa
*Assistant Examiner*—Katherine Moran
*Attorney, Agent, or Firm*—Goldstein & Canino

[57] ABSTRACT

A glove with attachable cleaning pads including a glove portion. A plurality of cleaning pads are provided that are adapted for removable coupling with a front surface of the glove portion. Each of the cleaning pads have a colored outer surface that is different from one another. Each of the cleaning pads have a different cleaning purpose.

2 Claims, 2 Drawing Sheets

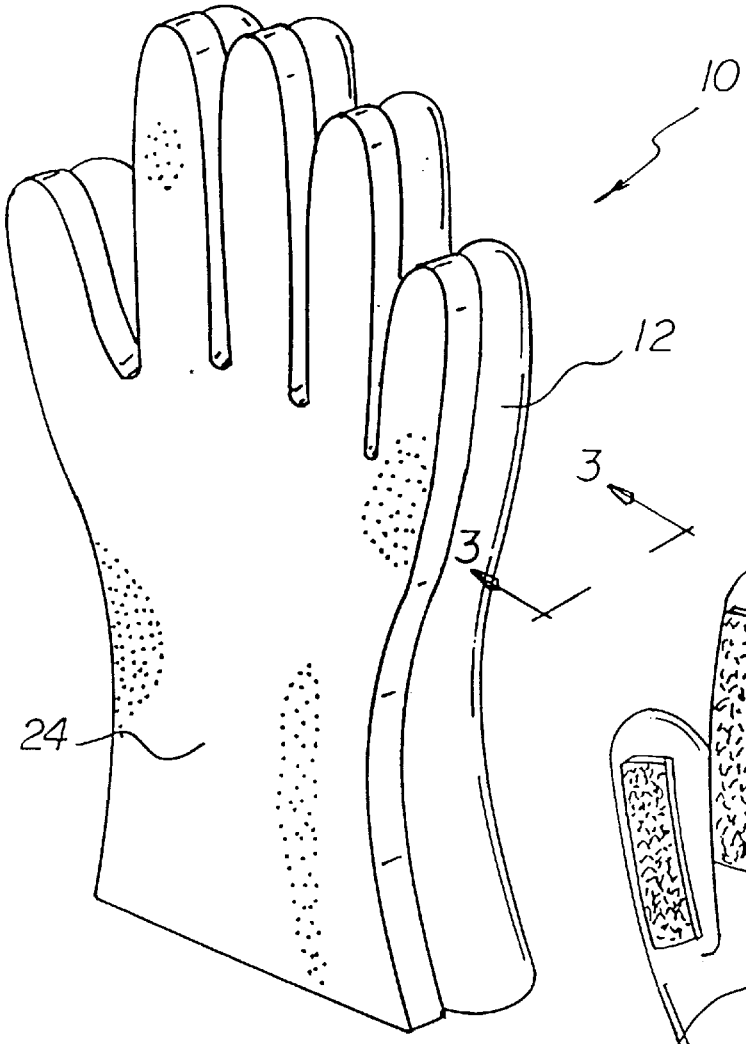
FIG 1
FIG 2
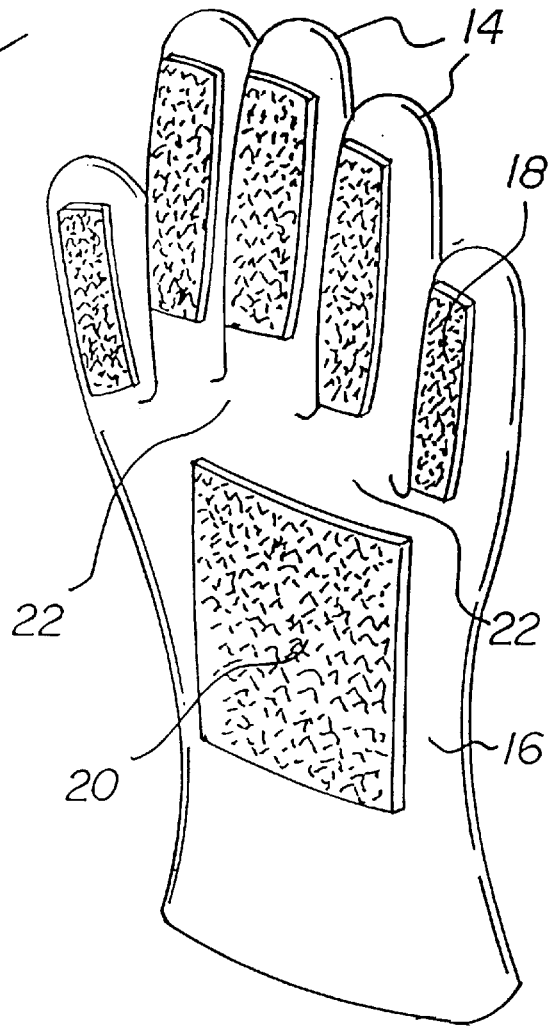

GLOVE WITH ATTACHABLE CLEANING PADS

BACKGROUND OF THE INVENTION

1. Field of the Invention

The present invention relates to a glove with attachable cleaning pads and more particularly pertains to allowing a person to effectively clean a surface with one hand with a glove with attachable cleaning pads.

2. Description of the Prior Art

The use of cleaning surfaces is known in the prior art. More specifically, cleaning surfaces heretofore devised and utilized for the purpose of are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,443,816 to Seketa; U.S. Pat. No. 4,593,427 to Ortolivo; U.S. Pat. No. 4,621,388 to Ortolivo; and U.S. Pat. No. 5,419,014 to Piantedosi.

While these devices fulfill their respective, particular objective and requirements, the aforementioned patents do not describe a glove with attachable cleaning pads for allowing a person to effectively clean a surface with one hand.

In this respect, the glove with attachable cleaning pads according to the present invention substantially departs from the conventional concepts and designs of the prior art, and in doing so provides an apparatus primarily developed for the purpose of allowing a person to effectively clean a surface with one hand.

Therefore, it can be appreciated that there exists a continuing need for new and improved glove with attachable cleaning pads which can be used for allowing a person to effectively clean a surface with one hand. In this regard, the present invention substantially fulfills this need.

SUMMARY OF THE INVENTION

In the view of the foregoing disadvantages inherent in the known types of cleaning surfaces now present in the prior art, the present invention provides an improved glove with attachable cleaning pads. As such, the general purpose of the present invention, which will be described subsequently in greater detail, is to provide a new and improved glove with attachable cleaning pads and method which has all the advantages of the prior art and none of the disadvantages.

To attain this, the present invention essentially comprises a glove portion having a front surface and a back surface. The glove portion further includes five finger receiving portions and a palm portion. The front surface has a plurality of hook and loops patches disposed thereon. The plurality of hook and loop patches include five finger patches disposed on the front surface of the five finger receiving portions and a palm patch disposed on the front surface of the palm portion. The plurality of hook and loop patches have a space disposed between the five finger patches and the palm patch to allow for proper maneuvering of a user's fingers therein. A plurality of cleaning pads are provided that are adapted for removable coupling with the front surface of the glove portion. Each of the cleaning pads have hook and loop fasteners disposed on a back surface thereof for mating with the hook and loop patches of the glove portion. Each of the cleaning pads have a colored outer surface that is different from one another. Each of the cleaning pads have a different cleaning purpose.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glove with attachable cleaning pads which has all the advantages of the prior art cleaning surfaces and none of the disadvantages.

It is another object of the present invention to provide a new and improved glove with attachable cleaning pads which may be easily and efficiently manufactured and marketed.

It is a further object of the present invention to provide a new and improved glove with attachable cleaning pads which is of durable and reliable construction.

An even further object of the present invention is to provide a new and improved glove with attachable cleaning pads which is susceptible of a low cost of manufacture with regard to both materials and labor, and which accordingly is then susceptible of low prices of sale to the consuming public, thereby making such a glove with attachable cleaning pads economically available to the buying public.

Even still another object of the present invention is to provide a new and improved glove with attachable cleaning pads for allowing a person to effectively clean a surface with one hand.

Lastly, it is an object of the present invention to provide a new and improved glove with attachable cleaning pads including a glove portion. A plurality of cleaning pads are provided that are adapted for removable coupling with a front surface of the glove portion. Each of the cleaning pads have a colored outer surface that is different from one another. Each of the cleaning pads have a different cleaning purpose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the glove with attachable cleaning pads constructed in accordance with the principles of the present invention.

FIG. 2 is a perspective view of the glove portion of the present invention.

The same reference numerals refer to the same parts through the various figures.

DESCRIPTION OF THE PREFERRED EMBODIMENT

Figure 3:
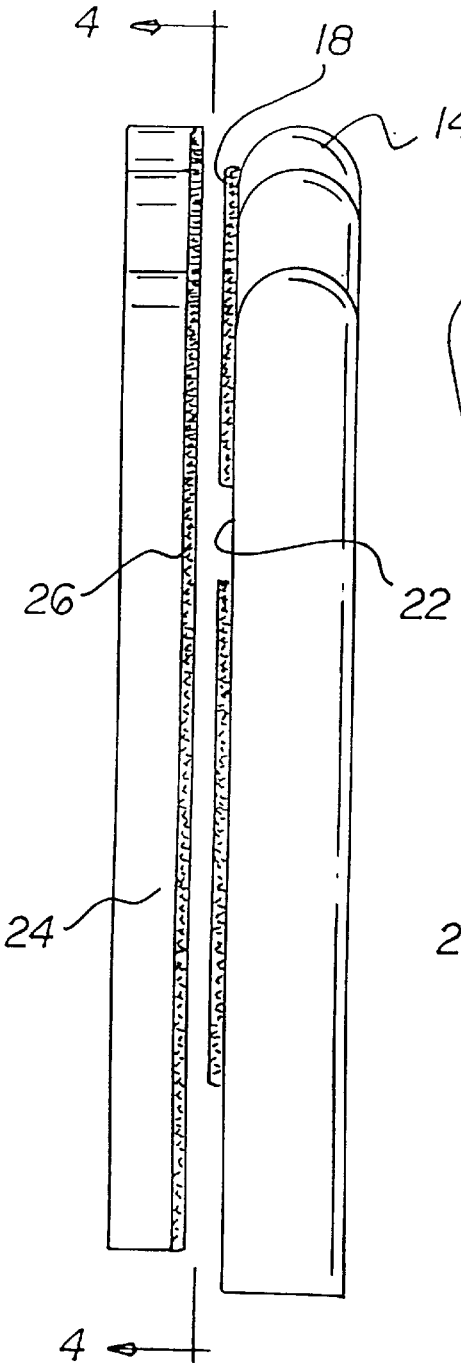
FIG. 3 is side view of the present invention as taken along line 3—3 of FIG. 1
Figure 4:
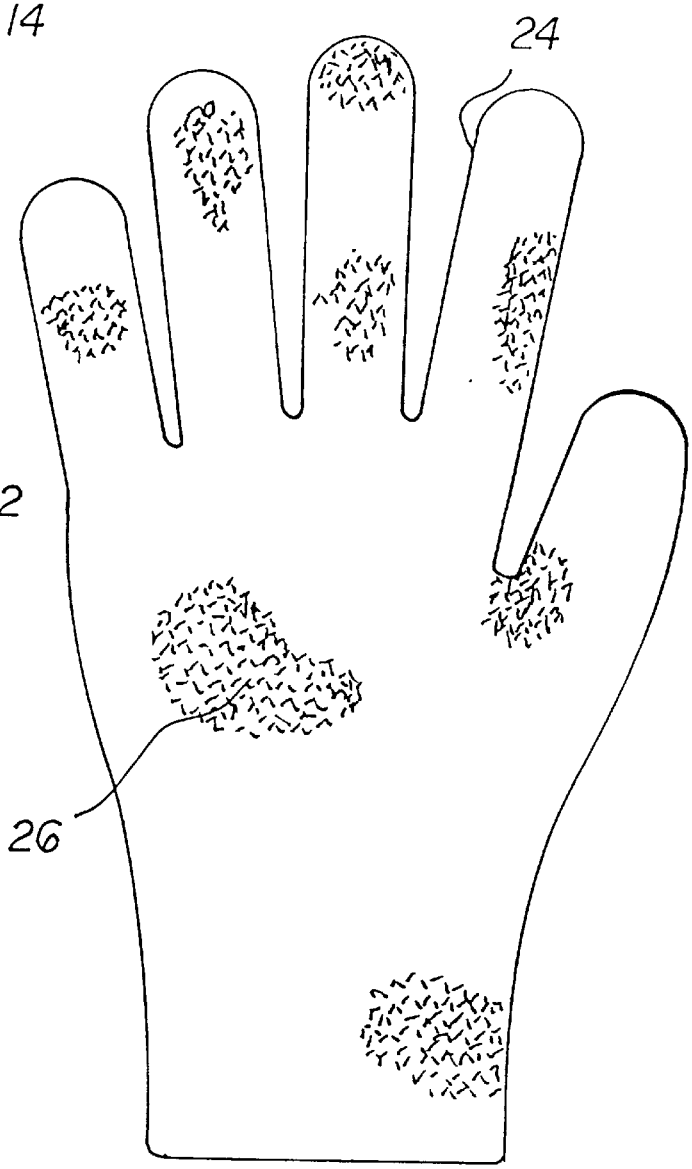
FIG. 4 is a plan view of one of the cleaning pads of the present invention as taken along line 4—4 of FIG. 3.

With reference now to the drawings, and in particular, to FIGS. 1 through 4 thereof, the preferred embodiment of the new and improved glove with attachable cleaning pads embodying the principles and concepts of the present invention and generally designated by the reference number 10 will be described.

Specifically, it will be noted in the various FIGURES that the device relates to a glove with attachable cleaning pads for allowing a person to effectively clean a surface with one hand. In its broadest context, the device consists of a glove portion and a plurality of cleaning pads. Such components are individually configured and correlated with respect to each other so as to attain the desired objective.

The glove portion 12 has a front surface and a back surface. The glove portion 12 further includes five finger receiving portions 14 and a palm portion 16. The front surface has a plurality of hook and loops patches disposed thereon. The plurality of hook and loop patches include five finger patches 18 disposed on the front surface of the five finger receiving portions 14 and a palm patch 20 disposed on the front surface of the palm portion 16. The plurality of hook and loop patches have a space 22 disposed between the five finger patches 18 and the palm patch 20 to allow for proper maneuvering of a user's fingers therein. The space 22 allows the user to freely bend and move their fingers while positioned within the glove portion 12. The glove portion 12 is preferably fabricated of a latex material that is similar to cleaning gloves in the art. The plurality of hook and loop patches can be substituted with alternate forms of securement means.

The plurality of cleaning pads 24 are adapted for removable coupling with the front surface of the glove portion 12. Each of the cleaning pads 24 are shaped in a form of a hand. Each of the cleaning pads 24 have hook and loop fasteners 26 disposed on a back surface thereof for mating with the hook and loop patches of the glove portion 12. Each of the cleaning pads 24 have a colored outer surface that is different from one another. Each of the cleaning pads 24 have a different cleaning purpose. The different colors of the cleaning pads 24 allows for the user to differentiate between the types of cleaning pads 24 in order to select the proper cleaning pad 24 to use. Once the proper cleaning pad 24 is selected, the user simply attaches it to the glove portion using the hook and loop patches. Having the cleaning pads 24 shaped in the form of the hand allows for a more effective cleaning of a chosen surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by letters patent of the United States is as follows:

1. A glove with attachable cleaning pads for allowing a person to effectively clean a surface with one hand comprising, in combination:

a glove portion having a front surface and a back surface, the glove portion further including five finger receiving portions and a palm portion, the front surface having a plurality of hook and loops patches disposed thereon, the plurality of hook and loop patches including five finger patches disposed on the front surface of the five finger receiving portions and a palm patch disposed on the front surface of the palm portion, the plurality of hook and loop patches having a space disposed between the five finger patches and the palm patch to allow for proper maneuvering of a user's fingers therein;

a plurality of cleaning pads adapted for removable coupling with the front surface of the glove portion, each of the cleaning pads being shaped in a form of a hand, each of the cleaning pads having hook and loop fasteners disposed on a back surface thereof for mating with the hook and loop patches of the glove portion, each of the cleaning pads having a different colored outer surface for allowing a person to select one of the cleaning pads for a particular cleaning purpose.

2. A glove with attachable cleaning pads for allowing a person to effectively clean a surface with one hand comprising, in combination:

a glove portion comprising a front surface, a back surface, five finger receiving portions, and a palm portion, wherein a plurality of hook and loop patches are disposed on the front surface, a front surface of the five finger portions and the palm portion, said hook and loop patches having a space disposed between the five finger patches and the palm patch to allow for proper maneuvering of a user's fingers therein;

a plurality of cleaning pads having hook and loop surfaces adapted for removable coupling with the hook and loop patches disposed on the front surface of the glove portion, each of the cleaning pads having a different colored outer surface for allowing a person to select one of the cleaning pads for a particular cleaning purpose.

* * * * *